United States Patent [19]

Fulton, Jr.

[11] Patent Number: 4,607,476

[45] Date of Patent: Aug. 26, 1986

[54] METHOD AND APPARATUS FOR STRETCH WRAPPING UNSTABLE LOADS

[76] Inventor: Cyrus B. Fulton, Jr., 5035 Wagon Trace, Birmingham, Ala. 35243

[21] Appl. No.: 754,211

[22] Filed: Jul. 12, 1985

[51] Int. Cl.[4] ..... B65B 13/02

[52] U.S. Cl. ..... 53/399; 53/587; 53/556; 53/441

[58] Field of Search ..... 53/210, 211, 399, 441, 53/465, 556, 587

[56] References Cited

U.S. PATENT DOCUMENTS

| | | | |
|---|---|---|---|
| 3,531,905 | 10/1970 | Omori | 53/447 |
| 3,568,393 | 3/1971 | King et al. | 53/339 |
| 4,050,220 | 9/1977 | Lancaster et al. | 53/556 |
| 4,152,879 | 5/1979 | Shulman | 53/399 |
| 4,178,734 | 12/1979 | Lancaster et al. | 53/399 |
| 4,454,705 | 6/1984 | Benno | 53/399 |
| 4,497,159 | 2/1985 | Lancaster | 53/399 X |

FOREIGN PATENT DOCUMENTS

| | | | |
|---|---|---|---|
| 1226025 | 9/1966 | Fed. Rep. of Germany | 53/586 |
| 2383074 | 11/1978 | France | 53/587 |

*Primary Examiner*—Robert L. Spruill
*Assistant Examiner*—Steven P. Weihrouch
*Attorney, Agent, or Firm*—Jennings, Carter, Thompson & Veal

[57] ABSTRACT

A palletized unstable load is stretch wrapped for unitization of the load to facilitate shipping through the use of a confinement container which contains a pallet and a lift for raising the pallet and load from the container. A stretched film is dispensed about the upper periphery of the container as the container is rotated on a turntable. As the load is raised it engages the film which is transferred from the top of the container to form a spiral about the load.

11 Claims, 4 Drawing Figures

METHOD AND APPARATUS FOR STRETCH WRAPPING UNSTABLE LOADS

FIELD OF THE INVENTION

The present invention relates to packaging of materials for transport and more particularly to packaging materials for transport on a pallet. More particularly the present invention relates to packaging materials with a stretch wrapped film serving to unitize the material for transport. In even greater particularity the invention may be described as a method and apparatus for palletizing an unstable load without side supports using stretch wrapping.

BACKGROUND OF THE INVENTION

The advent of stretch wrapping materials as a means of packaging goods for shipment has enabled shippers and packers to reduce the cost of packaging material and to a greater degree the weight of the packaging materials. The stretch wrap packaging uses a light-weight plastic film which is stretched about a load, usually situated on a pallet. The film contracts after being stretched and unitizes the load on the pallet. Although the film is usually less than a mil thick is has extraordinary strength when so applied, yet is also readily removed.

To package a load in this manner it is customary to dispense the film as the load is rotated so as to form a spiral of film about the load. While this basic concept is quite satisfactory for many applications, it has not been successfully applied to loads which are unstable and hence are pulled off the pallet by the film or slide off the pallet due to the absence of side support. In particular such items as empty cans and textiles are difficult to wrap in the conventional manner.

SUMMARY OF THE INVENTION

It is the principal object of the present invention to stretch wrap an unstable load of products that will not stack without side support. This object is advantageously accomplished through the use of a rotating, forming container which confines the load of products on a platform prior to the application of the stretched film to the load. The film is applied to the upper periphery of the container and an elevator within the container forces the load upward into contact with the film which is then transferred from the container to the load.

DESCRIPTION OF THE DRAWINGS

Apparatus embodying features of my invention are illustrated in the accompanying drawings which form a part of this application and wherein.

DESCRIPTION OF THE PREFERRED EMBODIMENT

Figure 1:
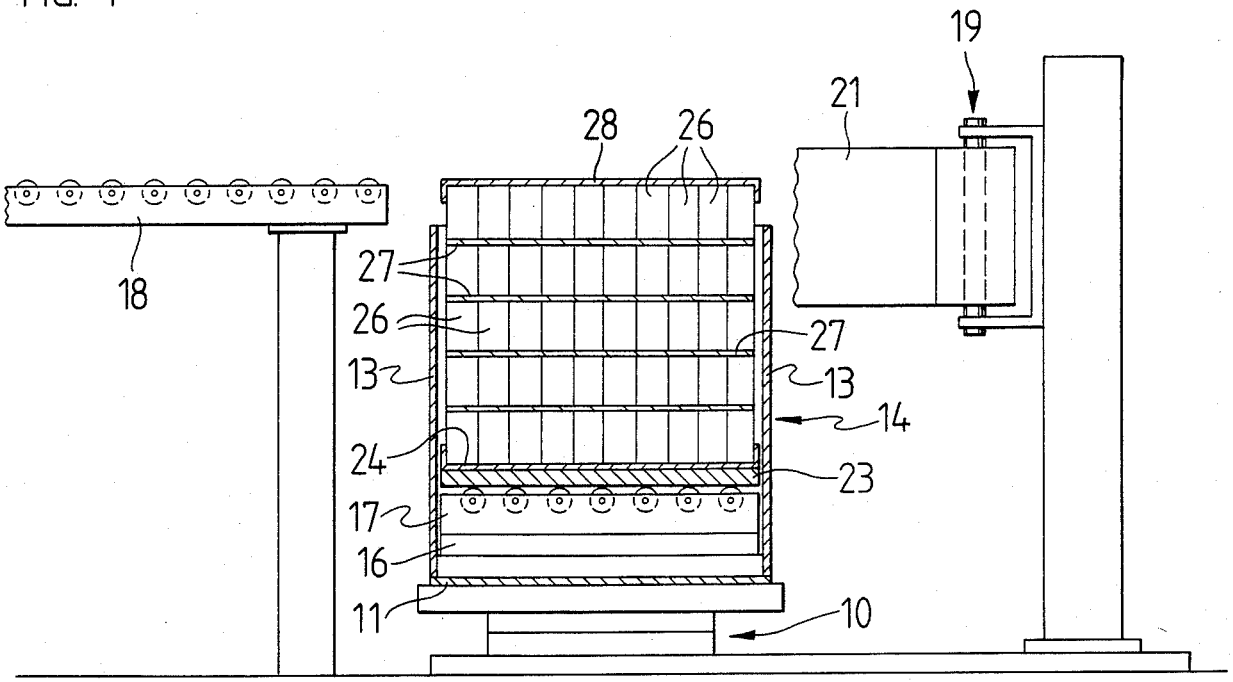
FIG. 1 is a sectional elevational view of the apparatus showing the load within the container.

When a light-weight or unstable product is to be palletized for shipment it has customarily been necessary to enclose the product in some rigid container to give the product support on each side. This is particularly true with empty cans and loose textile material. For the purpose of illustration the following description will refer to the product as empty cans; however it is to be understood that the apparatus and method claimed hereinafter is applicable to any unstable product which may be stretch wrapped in accordance with the claimed invention.

Referring to the drawings, a turntable 10, such as manufactured by International Packaging Machines, Inc. for use in conventional stretch wraping, is shown as the base upon which the invention operates. The turntable 10 has a controllable rate of rotation which can be manipulated in accordance with the character of the load. Positioned atop the turntable 10 is a plate 11 which is connected to the turntable by a hinge 12 and which is preferably made from steel or like material. Upstanding retaining walls 13 are attached to the plate 11 and form a container 14 which may be circular or rectilinear as desired for the particular product being packed. The top of the container 14 is open. The walls 13 are high enough to accommodate the load of product and a scissor lift 16 such as a Model 1070-1-E by American Scissor Lift. The scissor lift 16 is preferentially an electrically actuated hydraulic lift; however, any suitable lifting device may be employed.

A roller conveyor 17 comprising a plurality of parallel rollers is carried by the top of the scissor lift 16. When the scissor lift 16 is extended vertically the roller conveyor 17 is on a level with and can be aligned with a discharge roller conveyor 18. A film dispensing unit 19 such as the UniTension TM System made by International Packaging Machine, Inc. is located proximal the turntable 10. Although the unit 19 for dispensing a film 21 can be vertically movable as is conventional, it is not necessary that unit 19 be movable. Preferably the unit 19 is positioned at a height such that it feeds the film 21 directly to the upper portion of the walls 13 with half of the width of the film, or some other portion thereof, extending above the walls 13. Inasmuch as the walls are constant in height, unit 19 is also maintained at a constant height. The exterior surfaces of the walls 13 are coated with a layer of material such as Teflon TM or the like which will provide only minimal adherence to the film 21. That is to say, the film 21 should readily stick to the surface of the walls 13 and be entrained thereon by the rotation of the container 14; however the film 21 should be free to slide vertically on the walls if urged axially with respect to the turntable 10.

Figure 3:
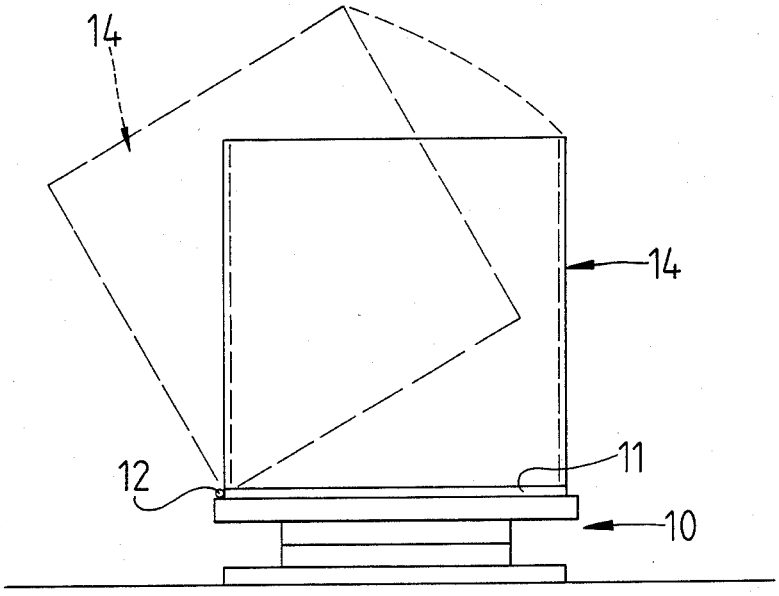
FIG. 3 is a side elevational view showing the container tilted for loading; and, FIG. 4 is a perspective view showing the load being wrapped.

In operation, the scissor lift 16 is placed in its fully lowered position. A pallet 23 is placed atop the roller conveyor 17 within the container 14. A separate bottom cap 24 or a bottom cap integrated with the pallet 23 receives the load of product atop the pallet 23. The product can be loaded into the container 14 as the container sits upright or the container 14 may be tilted on hinge 12 to facilitate loading, as shown in FIG. 3. When working with empty cans, designated by the numeral 26, a layer of cans is placed atop the bottom cap 24, then a separator sheet 27 is placed atop the cans. Another layer of cans is followed by another separator sheet and the layering is repeated until the container 14 is filled to a desired height, usually from thirty-six to forty-six inches. A top cap 28 fits over the upper layer of product, thus the entire load including top cap 28 and bottom cap 24 is confined by the container 14.

Figure 2:
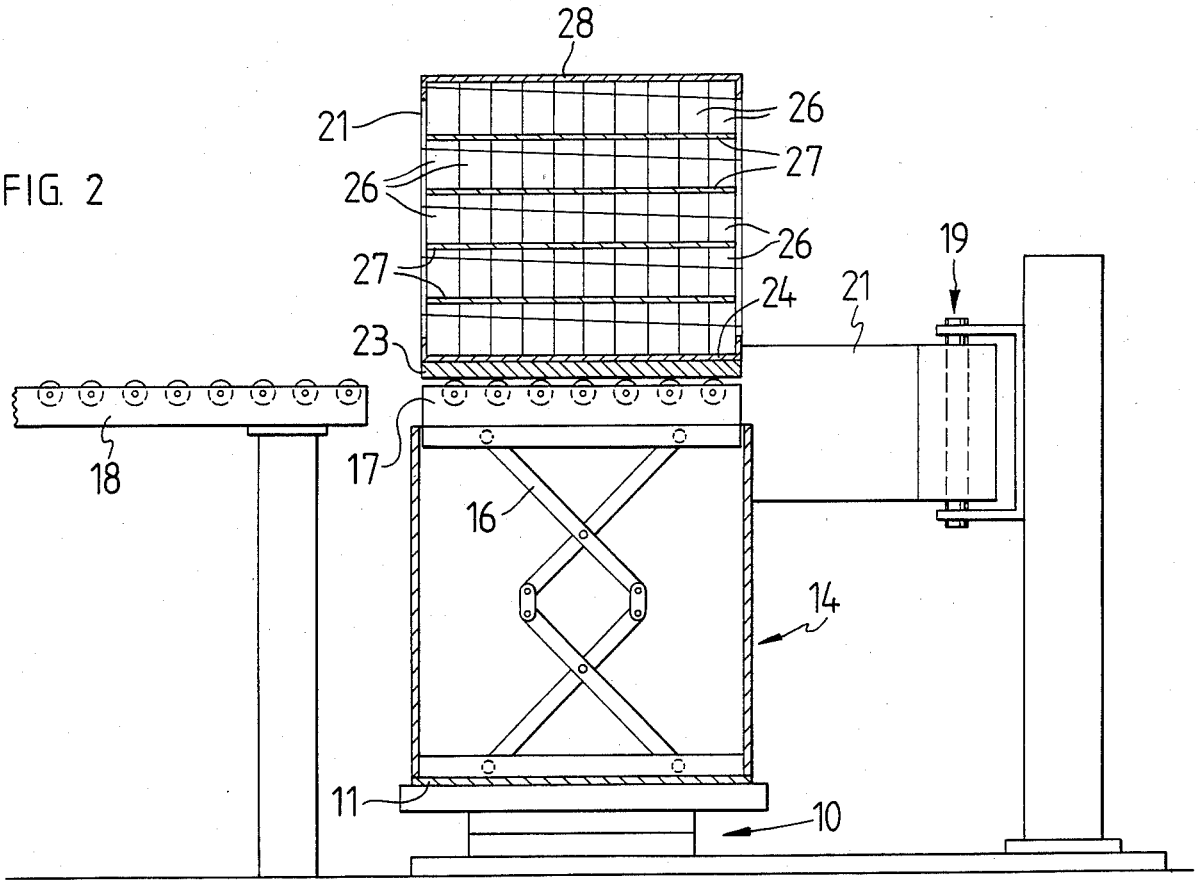
FIG. 2 is a sectional elevational view showing the load being extruded from the container.
Figure 4:
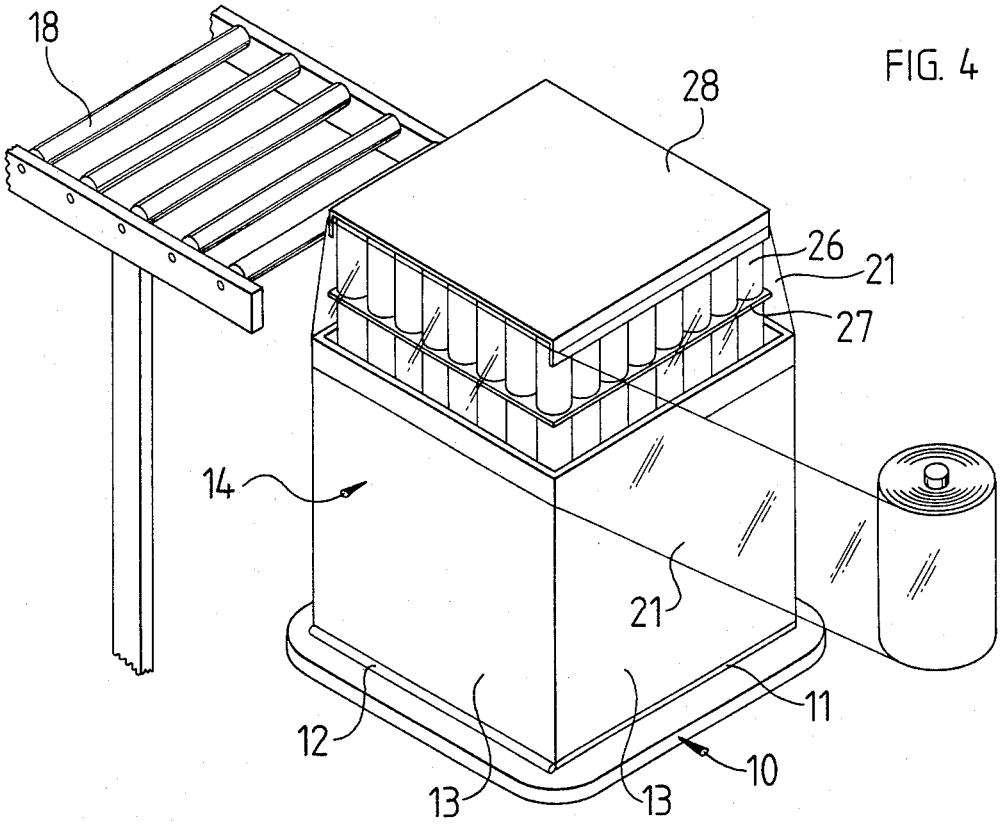

The turntable 10 begins to rotate and film dispenser 19 prestretches the film 21 which is then entrained about the rotating upper portion of container 14. As the turntable 19 rotates the scissor lift 16 urges the load of product upward so that the top cap 28 and the layers of product 26 progressively contact the portion of the film 21 extending above the container 14, as shown in FIG. 4. The film 21 adheres to the load more readily than to the container 14, thus as the sissor lift 16 urges the load upwardly the film 21 is carried upwardly with the load and transferred from the container 14 to the load. In this manner, the film 21 forms a spiral about the load and contracts as is conventional to unitize the load of product. When the lift 16 is in its full up position, as shown in FIG. 2, the turntable 19 is stopped, the film 21 is severed and the pallet 23 and the wrapped load is rolled off conveyor 17 onto the discharge conveyor 18 for movement to a loading dock or like area for further transportation. It may be noted that the separation between the film and product has been exaggerated for clarity in FIGS. 2 and 4.

While I have shown my invention in but one form, it will be obvious to those skilled in the art that it is not so limited, but is susceptible of various changes and modifications without departing from the spirit thereof.

What I claim is:

1. Apparatus for wrapping an unstable load with a stretch wrap film comprising:

(a) means for dispensing said film in a vertical plane to wrap said film about said load;

(b) means for rotating said load about a vertical axis to wrap said film about said load;

(c) a walled container having a bottom and being open at the top and affixed to said rotating means for confining said load prior to wrapping said film about said load with the upper periphery of said container engaging said film along the lower portion of said film as said load rotates; and (d) elevator means within said container for progressively raising said load out of said container into contact with said film so that said load is wrapped by said film as said load emerges from said container with said upper periphery of said container having an exterior surface which has minimal adhesion to said film whereby said film is transferred to said load from said container as the portion of said load adjacent thereto is raised above said container.

2. Apparatus as defined in claim 1 further comprising conveyor means mounted intermediate said load and said elevator means for removing said load from said elevator means when said load has been raised from said container and wrapped.

3. Apparatus as defined in claim 2 wherein said conveyor means comprises a plurality of parallel elongated rollers mounted horizontally atop said elevator means.

4. Apparatus as defined in claim 1 wherein said elevator means is an electrically controlled hydraulic scissor lift mounted within said container.

5. Apparatus as defined in claim 1 wherein said means for rotating comprises a powered turntable having a speed control.

6. Apparatus as defined in claim 1 wherein said container is hingedly affixed to said means for rotating.

7. A method of spiral stretch wrapping an unstable load without side supports utilizing a vertically aligned film dispenser, a turntable for rotating said load spaced from said dispenser, an upwardly opening container for housing said load preparatory to wrapping said load and an elevator for urging said load upwardly out of said container comprising the steps of:

(a) palletizing said load within said container;

(b) rotating said container and load about a vertical axis;

(c) dispensing said film in partial engagement with the exterior surface of the upper periphery of said container; and (d) urging said load upwardly out of said rotating container whereby said load engages said film and is wrapped by said upward movement of said load causing said film to transfer from said container to said load.

8. A method as defined in claim 7 further comprising removing said load from said elevator.

9. A method as defined in claim 7 wherein said palletizing step comprises:

(a) introducing a pallet into said container above said elevator;

(b) introducing said load into said container atop said pallet whereby said container provides side support for said load; and (c) topping said load within said container with a cap structure.

10. The method as defined in claim 9 wherein said introducing said load step comprises forming a predetermined number of layers of said load interleaved with a separator sheet between each layer thereof.

11. A method as defined in claim 7 wherein said dispensing means comprises:

(a) prestretching said film; and (b) feeding said film into wrapping engagement with said container such that a predetermined percentage of the width of said film is wrapped above the upper edge of said container and is engaged by said load as said load is urged upward whereby the said container insulates said load from unbalanced lateral forces generated by wrapping said film about said load.

* * * * *